United States Patent [19]

Meauze et al.

[11] 3,993,414

[45] Nov. 23, 1976

[54] SUPERSONIC COMPRESSORS

[75] Inventors: Georges D. Meauze, Paris; Jean-Jacques Thibert, Verrieres-le-Buisson; Jacky R. Leynaert, Igny, all of France

[73] Assignee: Office National d'Etudes et de Recherches Aerospatiales (O.N.E.R.A.), Chatillon-sous-Bagneux, France

[22] Filed: Oct. 18, 1974

[21] Appl. No.: 516,126

[30] Foreign Application Priority Data

Oct. 23, 1973 France ..... 73.37751

[52] U.S. Cl. ..... 415/181; 415/DIG. 1; 416/90 R; 416/228

[51] Int. Cl.[2] ..... F04D 21/00

[58] Field of Search ..... 415/181, DIG. 1; 230/120 S; 416/90, 231, 228

[56] References Cited

UNITED STATES PATENTS

| | | | |
|---|---|---|---|
| 2,575,682 | 11/1951 | Price | 230/120 S |
| 2,579,049 | 12/1951 | Price | 415/181 |
| 2,628,768 | 2/1953 | Kantrowitz | 415/181 |
| 2,663,493 | 12/1953 | Keast | 415/DIG. 1 |
| 2,678,537 | 5/1954 | Stalker | 415/DIG. 1 |
| 2,702,157 | 2/1955 | Stalker | 415/181 X |
| 2,749,025 | 6/1956 | Stalker | 415/181 |
| 2,749,027 | 6/1956 | Stalker | 415/181 |
| 2,925,952 | 2/1960 | Grave | 415/181 |
| 2,947,139 | 8/1960 | Havsmann | 415/181 |
| 2,966,028 | 12/1960 | Johnson et al. | 415/181 X |

FOREIGN PATENTS OR APPLICATIONS

| | | | |
|---|---|---|---|
| 1,032,468 | 6/1958 | Germany | 416/90 |

*Primary Examiner*—Martin P. Schwadron
*Assistant Examiner*—Robert J. Miller
*Attorney, Agent, or Firm*—Larson, Taylor & Hinds

[57] ABSTRACT

An axial supersonic compressor comprises a casing and a hub rotating in the casing and carrying blades. The suction surface of each blade is formed with a zone in which the curvative changes and which corresponds to a supersonic-subsonic shock wave. A channel formed in each blade and opening in said zone is connected to boundary layer aspiration means.

12 Claims, 4 Drawing Figures

SUPERSONIC COMPRESSORS

BACKGROUND OF THE INVENTION

The invention relates to supersonic compressors and especially supersonic flow compressors of the type called "axial," having at least one plurality of blades disposed uniformly about the compressor axis and at the level of which the flow slows down from supersonic relative speed to a less supersonic speed or subsonic speed through an orthogonal shock wave, at least at blade tips or possibly throughout the radial length of the blades.

One of the problems encountered in the construction of supersonic compressors resides in the interaction of the shock wave with the flow boundary layer along the casing defining the flow duct of the gas flow to be compressed and with the flow boundary layer along the blades.

SUMMARY OF THE INVENTION

It is an object of the present invention to provide a supersonic compressor in which the intensity of the shock wave which is produced during the change of speed is reduced and there is less risk of causing separation of the boundary layer from the casing and the blades, which separation may disturb operation of the compressor.

According to the invention, there is provided a rotary supersonic compressor comprising a casing having an axis defining an annular passage for a fluid to be compressed, a plurality of blades, each having a suction surface and a compression surface, disposed uniformly about the axis in said passage, wherein in operation the fluid flow passes through a shock wave from supersonic speed with respect to the blades to less supersonic or subsonic speed at least at the tips of the blades, wherein the suction surface of each blade is formed with a zone of change of curvature located to correspond with the position of the shock wave and each blade is formed with a channel connected to boundary layer aspiration means and opening on the suction surface into said zone.

This construction of the blades substantially reduces the interaction of the boundary layer with the shock wave arising from the leading edge of the following blade (and with the orthogonal shock wave which is generated, if the intake shock wave is not sufficiently violent, perpendicularly to the point of impact). The boundary layer trap avoids separation which leads to distrubances in operation.

The channel for trapping the layer may be formed to open on the suction surface of the blade over part only of its radial length from the tip, especially when the flow is only supersonic over a fraction of the radial extent of the blades (as in compressors with a low hub ratio). The channel can as well open over the whole radial extent of the blade, and in this case suction means may be provided both in the hub and in the casing. When the suction means are in the casing, they may be combined with an arrangement as described in French Pat. No. 71 46854.

According to another aspect of the invention, in a supersonic compressor of the above defined type, whose blades have at their tip a successively convergent shape over at least 10 percent of their structure in the axial direction, from their leading edge, then less converging or diverging over the rest of their structure, the place of change in slope is selected to correspond to the position of the shock wave in normal operation, the casing has a shape corresponding to that of the blades and is provided with an annular space for trapping the boundary layer in line with the change in convergence and provided with suction means. The plurality of blades may be borne by the rotary hub of the compressor or it may be fixed and constitute a flow rectifier which completes, if necessary, the compression stage.

The convergent profile of the casing, commenced from the up-stream edge of the blades, causes supersonic compression in the blades to start from the intake of the latter, hence reduces the intensity of the shock, in comparison with a compressor having a cylindrical casing and blades with a profile at their tip which is parallel to the axis. This result is due by aerodynamic phenomena which may, to a certain extent, be comparable with that of the flow in a divergent-convergent supersonic air-intake, whilst the application is totally different.

In practice, the blade tips and the casing may be very convergent over a length of the order of 15 to 20 percent of the longitudinal extent of the blades. However, there may also be provided a convergent shape all along the blades, and a less convergent or divergent shape to the casing from the output of the blades.

A half angle of conicity of the convergent portion of the casing between 15 and 20° may be regarded as advantageous. The convergent output portion may have a half angle of about 7°.

In supersonic compressors with a high hub ratio (in which the diameter of the hub at the location of the blade roots is a large fraction of the diameter of the casing in the same plane perpendicular to the axis) the supersonic speed may extend to the root of the blade. In this case, it may be advantageous to give the hub a profile comparable with that of the outside casing, that is to say with an input zone of steep slope, corresponding to rapid throttling of the flow, in the intake portin of the blades, then, after the shock wave, a zone of less slope.

In practice, the rear portion of the blades, which must be less convergent than the front portion, will advantageously be slightly divergent. Here again, in the case where the hub ratio is high or where there is a supersonic relative flow to the blade roots, the hub could be given a shape corresponding to that of the casing with also boundary layer suction means.

With this embodiment, not only is the intensity of the shock wave attenuated due to the fact of the compression produced by the ramp effect up-stream of the casing, but also the interaction of the shock wave with the boundary layer is attenuated, the separation of the boundary layer from the casing is avoided and a source of considerable operational disturbance is thus eliminated.

The invention will be better understood from a consideration of the following description of compressors which constitute particular embodiments of the invention given as non-limiting examples. The description refers to the accompanying drawings.

SHORT DESCRIPTION OF THE DRAWINGS

Figure 1:
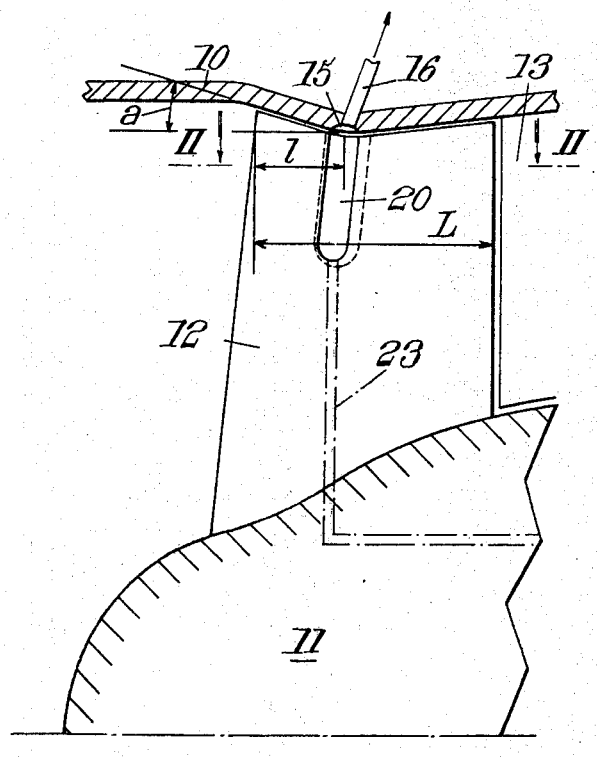
FIG. 1 shows very diagrammatically a fraction of a compressor according to a first embodiment, a single blade being shown without respect to its slope with respect to a plane passing through the axis.
Figure 3:
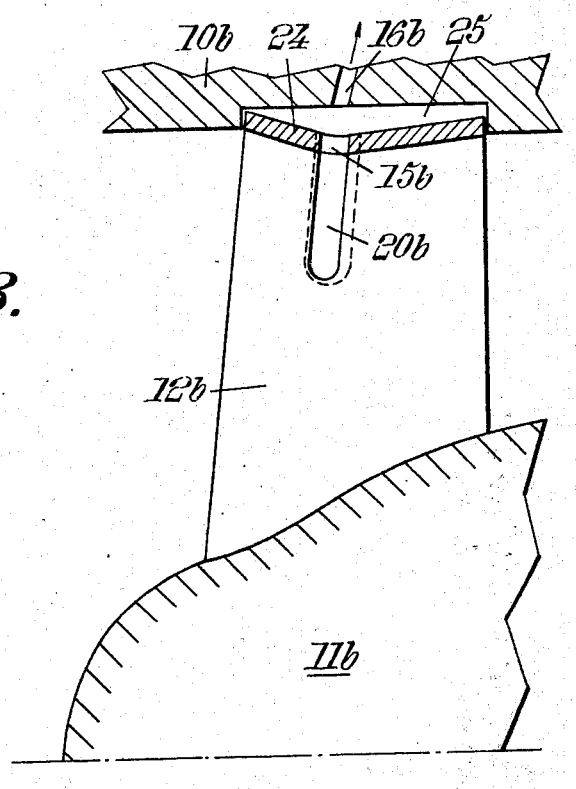

FIG. 3, similarly to FIG. 1, shows a modified embodiment; and

Figure 4:
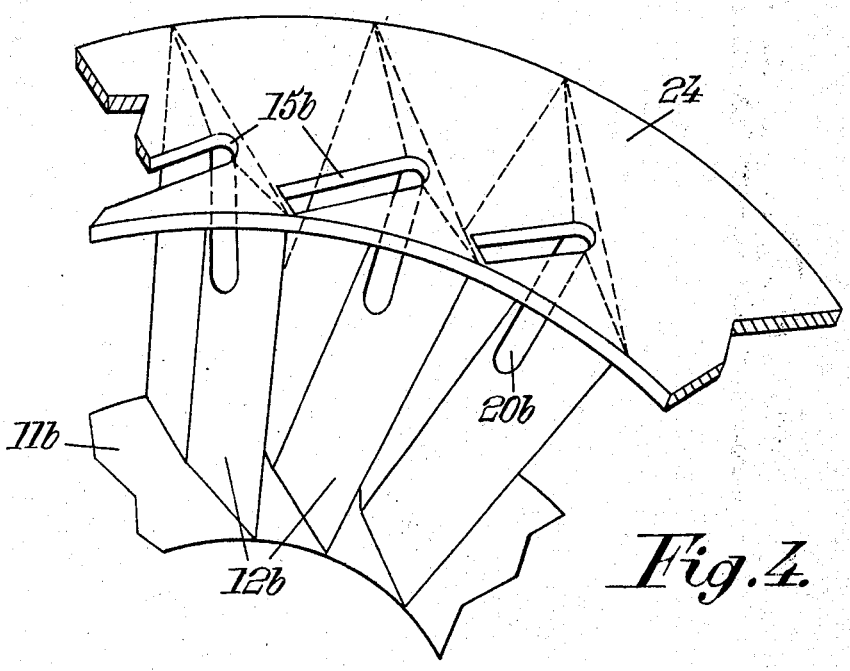

FIG. 4 is a view on an enlarged scale showing, in perspective, three successive blades of a compressor according to FIG. 3.

DESCRIPTION OF PREFERRED EMBODIMENTS

Referring to FIG. 1, a compressor comprises a casing 10 and a rotary hub 11.

Blades such as 12 are secured to the rotary hub 11. The casing 10 generally bears, behind the plurality of blades 12, a fixed plurality of flow rectifying vanes, occupying the zone indicated at 13. The casing 10 has, up-stream of the cascade of blades 12, a substantially cylindrical portion. Starting from the leading edge at the tips of the blades 12, the casing 10 has a convergent profile which continues over a length 1 which is at least equal to L/10, L being the longitudinal extent of the blade in axial direction at their tips. The casing then has a bend, then a less convergent profile, which may be cylindrical, less convergent or even divergent, but with an angle of divergence less than the angle *a* of convergence at the intake. In practice, l will generally be between 0.25 L and 0.3 L, but in certain cases a convergent profile could be adopted over the whole length L, the less convergent profile only occuring subsequently, at the level of the flow rectifying vanes 13.

The blades 12 have a longitudinal profile reproducing that of the casing, that is to say with a convergent shape at least at the front. An angle of convergence at the intake comprised between 15° and 10° can generally be adopted. The casing and the blades advantageously have over the rest of their axial extent a divergent shape, with a smaller angle, for example about 7°, so as to constitute a neck at the level of the intermediate bend.

The location of the bend is selected as a function of the characteristics of the compressor so that the shock wave on changing from supersonic speed to subsonic speed occurs at the level of this bend. The presence of the convergent casing attenuates the shock wave which occurs on the blade, very considerably. In fact, there is a progressive compression of the gas from the blade intake, especially close to the tips of the latter where the flow is more strongly supersonic from the intake.

The compressor illustrated in FIG. 1 has a boundary layer trap located in the zone of the bend, including an annular recess 15 connected by one or more passages 16 to a zone under suction with respect to the flow close to the recess 15. In practice, it suffices to aspirate a flow of the order of 0.2 percent of that which passes through the compressor to attenuate very substantially the interaction of the shock wave 14 with a boundary layer of the casing and the separation of this boundary layer. The gas aspirated at 16 (air for example) may often be used for auxiliary systems or reinjected at another place.

The blades of the compressor shown in FIG. 1 have each a boundary layer trap on the blade suction surface.

Figure 2:
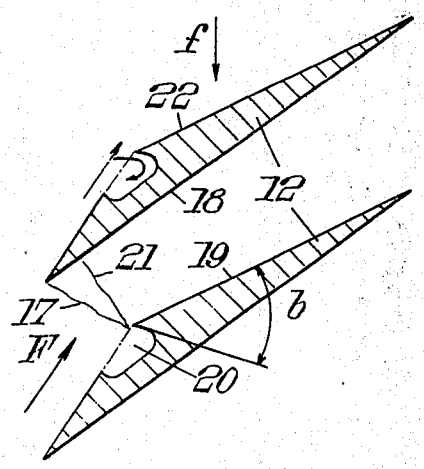
FIG. 2 shows very diagrammatically successive blades of the compressor of FIG. 1, in section on a cylindrical surface passing through the line II—II of FIG. 1.

In FIG. 2, which shows two successive blades, driven by the hub in the direction indicated by the arrow *f*, the relative flow with respect to the blades is indicated at F. At each leading edge of a blade a shock wave 17 is produced, arising from deflection of the incident flow by the initial slope of the pressure surface 18 of the blade, which has struck the suction surface 19 of the preceding blade. Along the same line from the suction surface 19, there can converge, if the intake shock 17 is not a high intensity one, an orthogonal shock wave 21. As a general rule, when it is desired to preserve a simple blade shape, the suction surface 19 of each blade 12 is given an up-stream profile with a steep slope, followed, behind the line of arrival of the shock wave 17 (if necessary line of convergence with the shock wave 21) by a zone with less slope.

The blades 12 have, in a zone which corresponds to the foot of the shock wave on the suction surface 19, a channel 20 connected to suction means for a fraction of the flow which passes through the compressor.

Each channel 20 may have a shape of the type illustrated in FIG. 2, and communicates with the gas flow which passes between two successive blades through a slit off-centred forwardly with respect to the channel. In fact, it is preferable that the channel should have in its rear portion, a zone separated from the flow by a sharp-angled edge, through which zone the flow of the gas from the boundary layer to the suction means is effected. However, to avoid excessive weakening of the edge, the angle *b* should generally be at least 45°.

It is not generally necessary for the opening slit of the channel 20 to extend over the whole length of the blade. In practice, it suffices for it to extend over the entire length where the speed of flow in the up-stream portion of the blade is greater than M 1.2. The bypass flow drawn into the channel 21 must be aspirated across one of the ends of the blade, tip or foot. In the embodiment illustrated in FIG. 1, this aspiration occurs through the annular recess or counterbore 15. When such a recess is not provided, each channel 20 may be connected by a hole 23 with the hub, and the hub is provided with aspirating means.

In FIG. 2, the rear edge of the slit communicating the channel 20 with the flow is located approximately at the change in slope. This feature must be preserved aproximately, even when the intake shock wave 17 is practically an orthogonal shock wave, reaching the suction surface more up-stream than illustrated.

In the modified embodiment of FIGS. 3 and 4 (where the members corresponding to those already shown bear the same reference numerals modified by the index *b*), the blades 12*b* are encircled by a ring 24. In this case the ring has, if necessary, on its inner surface the double slope profiled shape which was that of the casing of FIG. 1. FIG. 3 shows such a shape, whilst FIG. 4 shows a ring with a constant slope.

Between the ring 24 and the casing 10*b* there may be (FIG. 3) an annular chamber 25 which is connected to the suction means 16*b*.

In this case again, the blades are provided with channels 20*b* connected to the chamber 25 by slits 15*b* and these slits may then be arranged according to the feature described and claimed in the previously mentioned French Pat. No. 71 46854.

We claim:

1. In a rotary supersonic compressor comprising a casing having an axis, a rotor mounted for rotation about said axis and having a hub carrying a first set of blades spaced from said axis, regularly distributed about said axis and defining axial passages for a gaseous fluid to be compressed, a second set of blades carried by said casing,, spaced from said axis, regularly distributed about said axis and defining axial passages receiving fluid from the passages of said rotor, said rotor being arranged to be driven in operation at a speed sufficient for the gaseous fluid to experience a shock wave transition from supersonic speed to a lesser speed at least in the radially outward portion of the blades of one of said first and second sets, the improvement wherein the suction surface of each blade of the said one set is formed with a zone of change of curvature located to correspond with the position of the shock wave, and each blade is formed with a channel connected to boundary layer aspiration means and opening in the suction surface into said zone, the rear portion of each said channel in the direction of flow being separated from the gas flow bounded by two successive blades, by a rim terminated by an edge limiting the opening of the channel into said suction surface.

2. In a rotary supersonic compressor comprising a casing having an axis, a rotor mounted for rotation about said axis, a plurality of blades carried by said rotor for rotation therewith, each said blade having a suction surface and a compression surface and having a tip and a root, said blades being regularly distributed about the said axis and spaced from said axis, said blades defining fluid passages, wherein in operation said rotor is rotated at a speed sufficient for the fluid to pass through a shock wave from supersonic speed with respect to the blades to a lesser speed at least at the tips of the blades, the improvement wherein the suction surface of each blade is formed with a zone of change of curvature located to correspond with the position of the shock wave, and each blade is formed with a channel connected to boundary layer aspiration means and opening on the suction surface into said zone, the rear portion of each channel in the direction of flow being separated from the gas flow bounded by two successive blades, by a rim terminated by an edge limiting the opening of the channel into said suction surface.

3. In a rotary supersonic compressor comprising a casing having an axis, a rotor mounted for rotation about said axis, a plurality of blades carried by said rotor for rotation therewith, each said blade having a suction surface and a compression surface and having a tip and a root, said blades being regularly distributed about the said axis and spaced from said axis, said blades defining fluid passages, wherein in operation said rotor is rotated at a speed sufficient for the fluid to pass through a shock wave from supersonic speed with respect to the blades to a lesser speed at least at the tips of the blades, the improvement wherein the suction surface of each blade is formed with a zone of change of curvature located to correspond with the position of the shock wave, each blade being formed with a channel connected to boundary layer aspiration means and opening on the suction surface into said zone, and at said rotational speed each said blade has a radial height sufficient for the speed of the fluid rrelative to the blade at the root of the blade to be lower than Mach 1 and each said channel extends along the shock wave zone from the tip of the blade at least to the zone of the blade which receives fluid from a zone wherein the intake speed is at least equal to Mach 1.2.

4. Compressor according to claim 2 wherein the suction surface of each said blade has an intake profile with a steep slope and an output profile with a reduced slope, said channel opening in the suction surface through a slit whose downstream edge is close to the zone of change of slope.

5. Compressor according to claim 2 wherein the channel communicates with said aspiration means through passages formed in a rotary hub of the compressor carrying said blades.

6. In a rotary supersonic compressor comprising a casing having an axis, a rotor mounted for rotation about said axis, a plurality of blades carried by said rotor for rotation therewith, each said blade having a suction surface and a compression surface and having a tip and a root, said blades being regularly distributed about the said axis and spaced from said axis, said blades defining fluid passages, wherein in operation said rotor is rotated at a speed sufficient for the fluid to pass through a shock wave from supersonic speed with respect to the blades to a lesser speed at least at the tips of the blades, the improvement wherein the suction surface of each blade is formed with a zone of change of curvature located to correspond with the position of the shock wave, each blade being formed with a channel connected to boundary layer aspiration means and opening on the suction surface into said zone, the blade tips having a shape which is successively convergent over a portion of at least 10% of their extent in the axial direction from their leading edge, and left convergent over the rest of their extent, and the casing having a passage defining a surface whose shape corresponds to that of the blades and is formed with an annular space for trapping the boundary layer, said space being in the same radial plane as the change in convergence and being provided with aspiration means.

7. Compressor according to claim 6, wherein the convergent intake portion corresponds between 25 and 30 percent of the extent of the blades in the axial direction at the tip of the blade.

8. Compressor according to claim 6, wherein the convergent intake portion corresponds to a half angle of convergence comprised between 15° and 20° whilst the output portion corresponds to a half angle of divergence of about 7°.

9. Compressor according to claim 6, wherein at said speed of rotation the intake speed is supersonic with respect to the blades over the whole of the radial height of the blades, the rotary hub of the compressor bearing the blades has an axial section whose curvature changes in the plane of the shock wave, and a trap provided with aspiration means for the boundary layer is formed in the zone of change of curvature.

10. Compressor according to claim 6, wherein the aspiration means from said channel are common with the aspiration means starting from said annular space.

11. Compressor according to claim 10, wherein the blades being encircled by a ring, the inner surface of said ring having a shape corresponding to that of the blade tips and orifices communicating with an annular recess provided in the casing and connected to said boundary layer aspiration means being formed in said ring between successive blades.

12. Compressor according to claim 10 wherein said aspiration means are so constructed and arranged that the toal boundary layer aspiration flow is less than 5 percent of the flow passing through the compressor.

* * * * *